US005983595A

United States Patent [19]

Focke et al.

[11] Patent Number: 5,983,595

[45] Date of Patent: Nov. 16, 1999

[54] PACKAGING MACHINE FOR PRODUCING HINGE-LID BOXES

[75] Inventors: Heinz Focke, Verden; Hermann Blome, Blender-Einste, both of Germany

[73] Assignee: Focke & Co., Verden, Germany

[21] Appl. No.: 09/050,077

[22] Filed: Mar. 30, 1998

[30] Foreign Application Priority Data

Apr. 1, 1997 [DE] Germany ..... 197 13 231

[51] Int. Cl.[6] ..... B65B 11/28

[52] U.S. Cl. ..... 53/234; 53/207; 493/164

[58] Field of Search ..... 53/234, 207, 232; 493/163, 164, 175, 176, 172

[56] References Cited

U.S. PATENT DOCUMENTS

| | | | |
|---|---|---|---|
| 1,359,181 | 11/1920 | Lietz | 53/234 |
| 4,084,393 | 4/1978 | Focke | 53/137 |
| 5,024,043 | 6/1991 | Draghetti et al. | 53/234 |
| 5,555,708 | 9/1996 | Shower et al. | 53/563 |
| 5,694,738 | 12/1997 | Shigeta | 53/234 |

FOREIGN PATENT DOCUMENTS

| | | |
|---|---|---|
| 205894 | 5/1986 | European Pat. Off. . |
| 315821 | 5/1989 | European Pat. Off. . |
| 560164 | 9/1993 | European Pat. Off. . |
| 2463385 | 4/1986 | Germany . |
| 2463386 | 4/1986 | Germany . |
| 3522614 | 1/1987 | Germany . |
| 3536791 | 4/1987 | Germany . |
| 3941844 | 6/1991 | Germany . |

*Primary Examiner*—Joseph J. Hail, III
*Assistant Examiner*—Ed Tolan
*Attorney, Agent, or Firm*—Sughrue, Mion, Zinn, Macpeak & Seas, PLLC

[57] ABSTRACT

A packaging machine for producing hinge-lid boxes for cigarettes has a rotating folding turret which has a plurality of pockets (21) which are open in the radial direction. For the purpose of securing blanks (11) or partially completed hinge-lid boxes (10) in the pockets (21) of the folding turret, protrusions (32) are arranged in the pockets (21) and have a supporting surface (34) for abutting a closure edge (18) of an inner side tab (14) of the blank (11). For the purpose of discharging a hinge-lid box (10) from the pocket (21), the retaining force which is exerted by the protrusion (32) is overcome.

6 Claims, 5 Drawing Sheets

PACKAGING MACHINE FOR PRODUCING HINGE-LID BOXES

BACKGROUND OF THE INVENTION

The invention relates to a packaging machine for producing packs, in particular of the hinge-lid box type, having a rotating folding turret on whose circumference there are arranged a plurality of—approximately—radially directed pockets of U-shaped cross-section, open on the radially outer side for forming a filling opening, for receiving blanks or partially completed packs, the U-shaped folded blanks abutting the pocket side walls with side tabs and lid side tab, said side tabs, on the one hand, and lid side tabs, on the other hand, being delimited from one another by obliquely directed closure edges and lid closure edges, respectively.

The use of hinge-lid boxes or hinge-lid packs as cigarette packs is very common throughout the world. In the case of the internationally accepted configuration of this type of pack, a pivotable lid is arranged on a box part. Narrow side walls of the hinge-lid box comprise two layers, namely, in the region of the box part, an inner side tab and an outer side tab. Analogously to this, lid side walls comprise an inner lid side tab and an outer side tab. The box part and lid are separated off from one another, in the region of the front wall and side walls, by closure edges. The latter run obliquely in the region of the side walls.

The packaging machines for producing such packs are operating more and more with high folding-turret rotational speeds. This results in centrifugal forces acting on the blanks or partially completed packs in the pockets. If the pockets are configured with a U-shaped cross-section and an open radially outer side, there is a risk of the blanks or packs sliding out of the pocket. The problem outlined primarily arises in the case of packaging machines in which the plate-like folding turret is arranged so as to rotate about a vertical axis.

SUMMARY OF THE INVENTION

The object of the invention is to ensure, by relatively straightforward means, the reliable fixing of blanks or partially completed packs in pockets of a folding turret.

In order to achieve this object, the inventive apparatus or packaging machine is characterized in that arranged on the inner side of the pocket side walls in a radial exterior region—adjacent to the filling opening—is an inwardly projecting stop or protrusion onto which the closure edge of the side tab abuts.

The contour of the stop corresponds to the configuration of the closure edge of the side tab, and is thus correspondingly obliquely directed. Furthermore, the stop is configured, and dimensioned, so as to absorb the loading to which the blank or the partially completed pack is subjected as a result of centrifugal force. In contrast, during discharge of the partially completed pack from the pocket, the invention provides for the restraining force of the stop to be overcome. For this purpose, the stop is designed with an obliquely directed abutment surface along which the closure edge slides during discharge of the partially completed pack from the pocket.

Further details of the invention relate to the configuration of the stop, or of a stop-containing protrusion, on the pocket side wall and to further retaining elements for temporarily fixing the blank or the partially completed pack in the pocket.

An exemplary embodiment of the invention is explained in more detail hereinbelow with reference to the drawings, in which:

DESCRIPTION OF A PREFERRED EMBODIMENT

Figure 1:
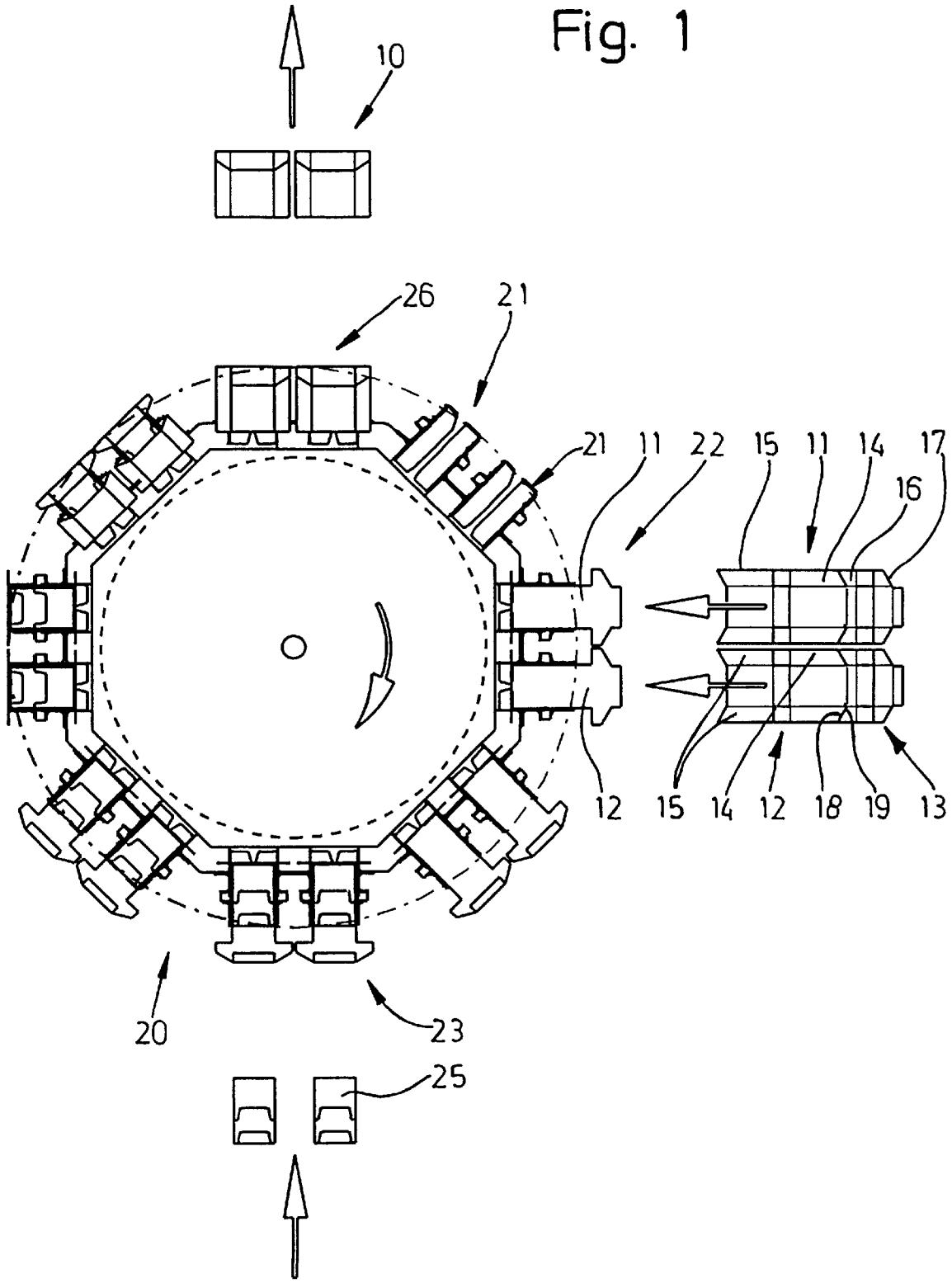
FIG. 1 shows a plan view of a folding turret in a schematic illustration.
Figure 2:
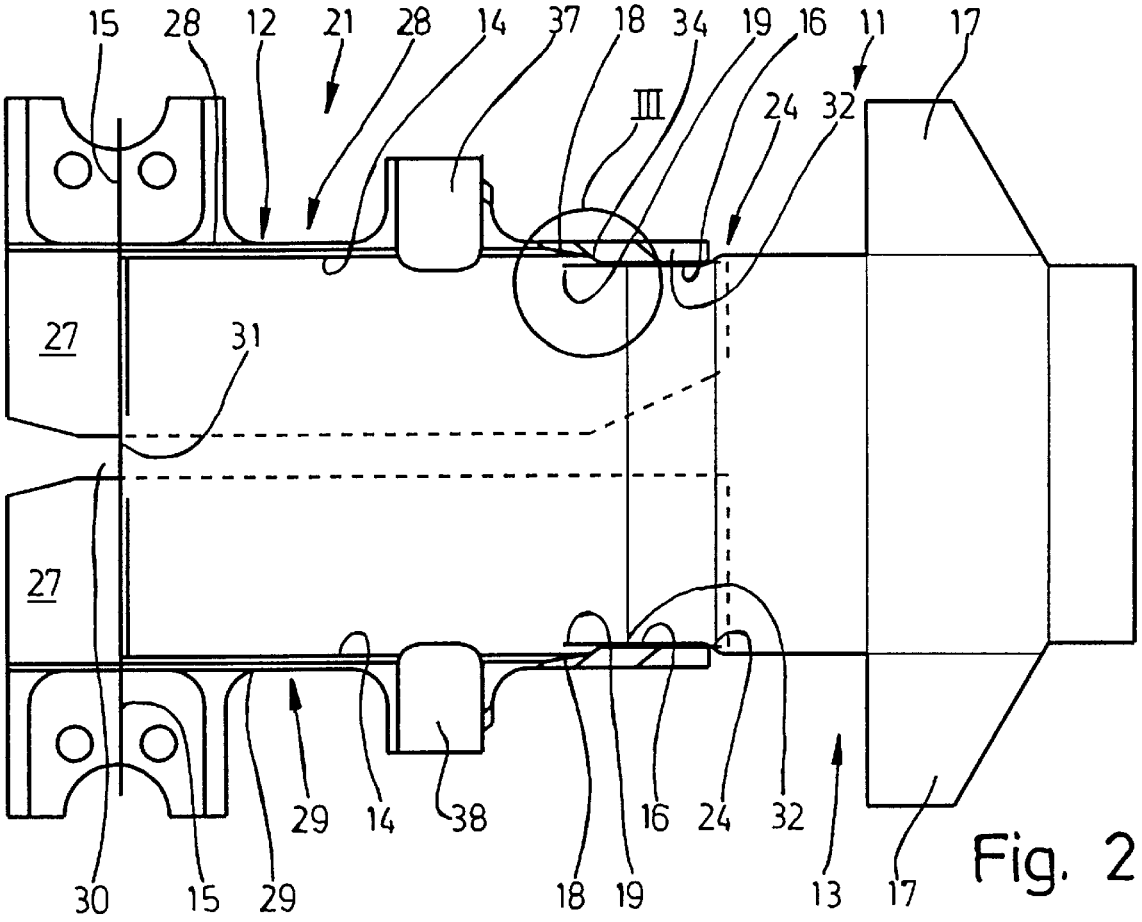
FIG. 2 shows, on an enlarged scale and likewise in plan view, a pocket of a folding turret with a blank.
Figure 3:
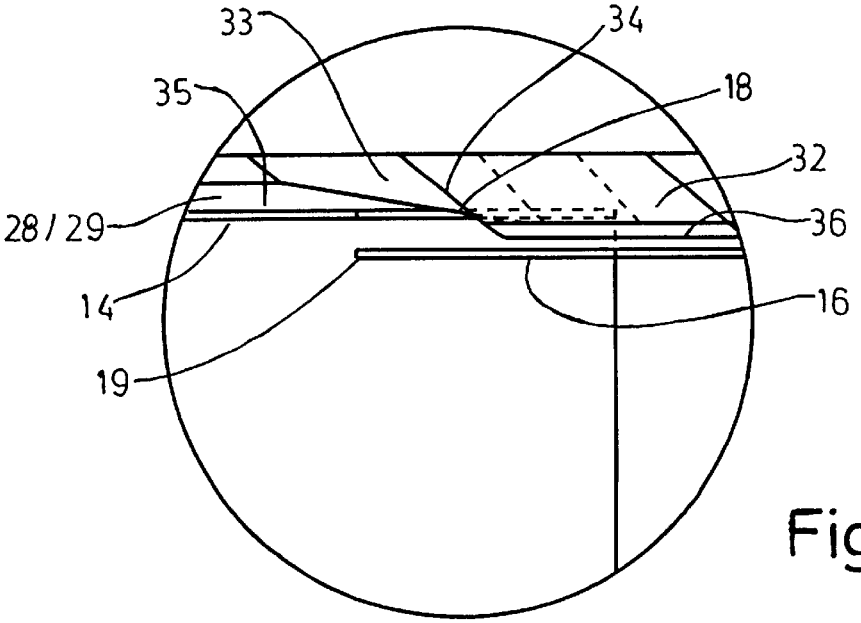
FIG. 3 shows, on a further-enlarged scale, a detail III of the pocket according to FIG. 2.
Figure 4:
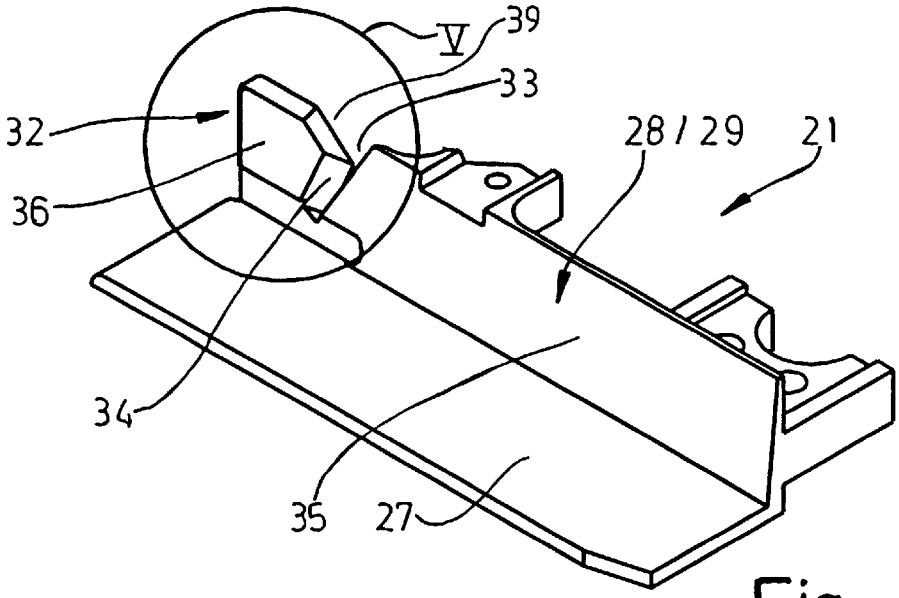
FIG. 4 shows a perspective inside view of part of a pocket.
Figure 5:
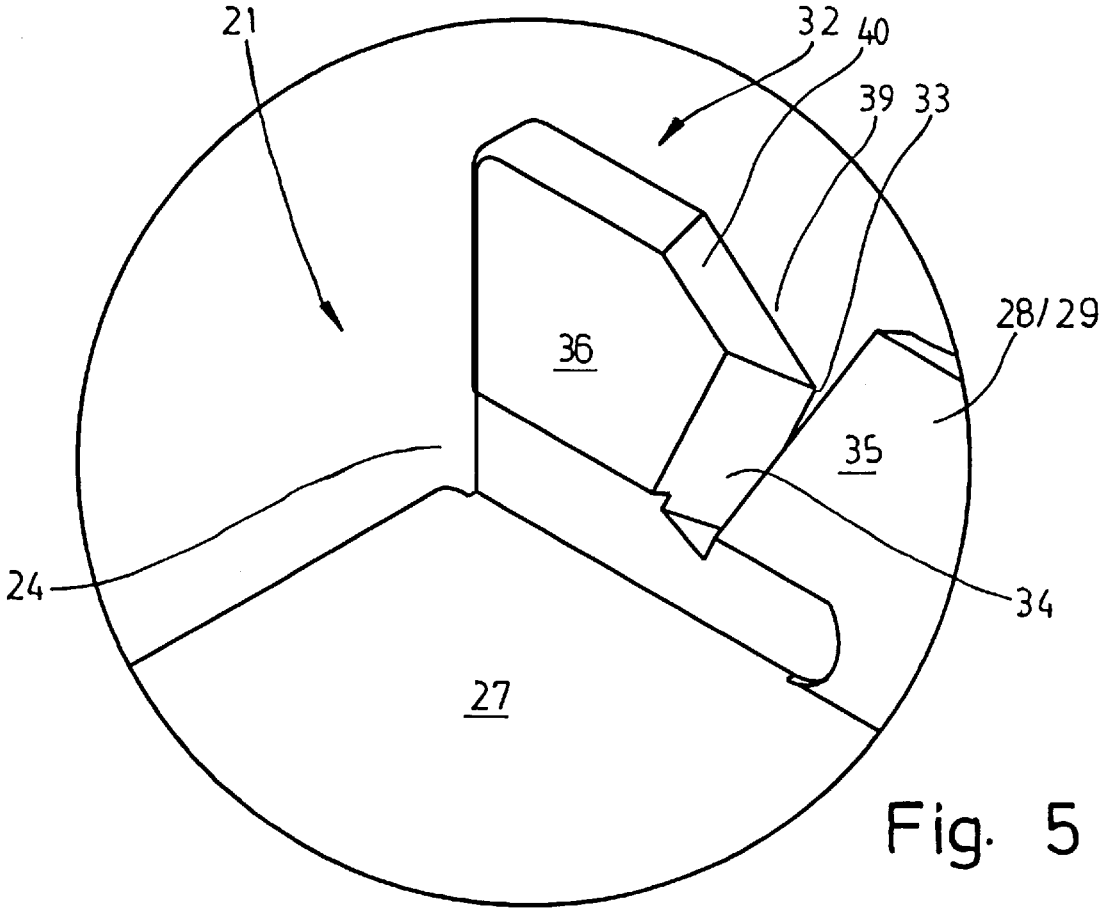
FIG. 5 shows, on an enlarged scale, a detail V of FIG. 4.
Figure 6:
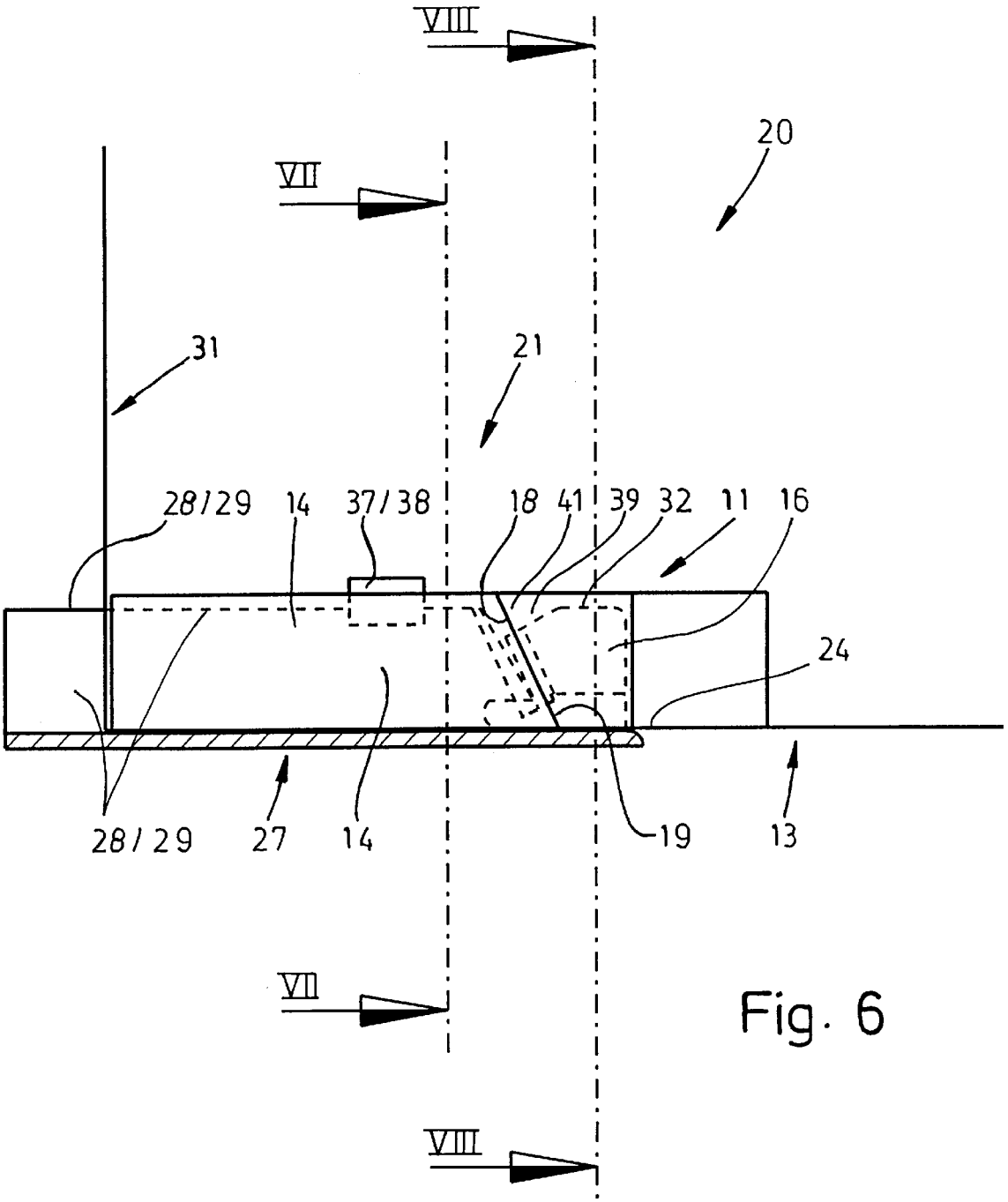
FIG. 6 shows a longitudinal section of a pocket with a partially folded blank.

The drawings show a preferred exemplary embodiment, namely a packaging machine for producing hinge-lid boxes 10 for cigarettes. This type of pack is produced from blanks 11 which consist of thin cardboard and are of the characteristic configuration which can be seen in FIG. 1. The blanks 11 are provided with punch cuts and folding lines for defining blank regions for a box part 12 and a lid 13. Narrow side walls of the hinge-lid box 10, namely of the box part 12, on the one hand, and of the lid 13, on the other hand, are formed in each case by two folding tabs which are located one above the other and connected to one another by adhesive bonding. These tabs are in each case an inner side tab 14 and an outer side tab 15 as well as an inner lid side tab 16 and an outer lid side tab 17. The side walls, on the one hand, and lid side walls, on the other hand, which are formed by these folding tabs are separated from one another by obliquely directed closure edges 18 and lid closure edges 19. Within the unfolded blank (FIG. 1), the inner side tab 14 is separated from the directly adjacent inner lid side tab by an obliquely directed punch cut which bounds, on the one hand, the closure edge 18 of the side tab 14 and, on the other hand, the lid closure edge 19 of the inner lid side tab 16.

A blank which is designed in the manner described and is known in general is processed in a packaging-machine folding turret 20, which in this case is designed as a plate-like rotating body and is driven in rotation about a vertical axis. The folding turret 20 is provided, along the circumference, with a plurality of pockets into which the blanks 11 are introduced. As a result of the configuration of the folding turret 20, the pockets 21 are positioned in a horizontal plane and aligned (approximately) radially. In the case of the present exemplary embodiment, the folding turret 20 is intended for simultaneously receiving and processing two blanks 11, that is to say for double-track operation. Two corresponding pockets 21 are thus always arranged parallel one beside the other. Correspondingly, two blanks 11 are introduced simultaneously in each case, in the region of a blank station 22, into the associated pockets 21.

Upon introduction of the blanks 11 into the pockets 21, the first folding steps are carried out. Following stepped rotation, the pockets 21 pass into a filling station 23. Here, the pack contents are pushed radially, to be precise via a filling opening 24, into the pockets 21, which are open on the radially outer side. In the case of the present exemplary embodiment, cigarette groups which are wrapped in an inner wrapper, that is to say cigarette block 25, are introduced in pairs into the pockets 21 or into the already partially folded blanks 11.

Following further stepped rotation and folding steps, the largely completed hinge-lid boxes 10 are discharged from the pockets 21 on the opposite side, in the region of a discharge station 26, and fed to further folding elements and a gluing station.

The pockets 21 are designed to have a U-shaped cross-section, that is to say, they have a pocket base 27 and two pocket side walls 28, 29. The pockets are open on the radially inner side and on the radially outer side, as well as at the top. The filling opening is formed on the radially outer side.

In the case of the present example, a special feature is that the pocket 21 comprises two angled part-pockets which are separated from one another by a central gap 30. During discharge of the hinge-lid boxes 10 in the region of the discharge station 26, a conveying element, for example a carry-along member of an endless conveyor, can pass through this gap 30.

In the region of the blank station 22, the blanks 11 are fed on a blank track (not shown), which runs above the folding turret 20, and are introduced into the associated pockets 21 by virtue of downward movement. First folding steps are performed by virtue of the blanks 11 being pressed into the associated pocket 21. A blank leg 31, which comprises a base wall and a front wall with the outer side tabs 15, is folded into an upright position. In the same way, the inner side tabs 14 and the inner lid side tabs 16 are folded into the upright position, with abutment against the inside of the two pocket side walls 28, 29. In this station, a sub-region of the lid 13 projects, in the unfolded state, out of the pocket 21, specifically beyond the filling opening 24.

Further details of the construction and operation of the folding turret 20 can be gathered from U.S. Pat. No. 4,084,393.

The blank 11, or the hinge-lid box 10 which is largely completed in the region of the folding turret 20, is secured within the pockets 21 against undesired movement in the direction of the filling opening 24, that is to say against movement out of the pocket 21 in the radial direction.

Centrifugal forces act on the blanks 11, in particular, during the rotational movements of the folding turret 20.

For the purpose of securing the blanks 11, there are formed, on the two pocket side walls 28, 29, stops, against which (free) edges or borders of the blank 11 in the pockets 21 abut. In the case of the present example, each of the two pocket side walls 28, 29 is provided with a protrusion 32. The latter is part of the pocket side walls 28, 29, namely an end region which is directed towards the filling opening 24. An end section of the pocket side wall 28, 29 forms the inwardly directed protrusion, which projects inwards beyond the inner surface of the pocket 21 formed by the pocket side wall 28, 29. The protrusion 32 is separated from the remaining part of the pocket side wall 28, 29 by a gap 33, which in this case extends over part of the height of the pocket side wall 28, 29.

An obliquely directed supporting surface 34 of the protrusion 32 serves as a supporting stop for the blank 11. The supporting surface is beveled from the outside to the inside in the direction of the filling opening 24, that is to say towards the radially outer side of the pocket 21.

The closure edge 18 of the (inner) side tab 14 of the blank 11 butts against the supporting surface 34. For this purpose, the supporting surface 34 is likewise arranged obliquely, to correspond to the inclination of the closure edge 18, that is to say it is arranged so as to be inclined with respect to the pocket base 27 and the filling opening 24. The supporting surface 34 only extends over a sub-region of the height of the pocket side walls 28, 29, approximately in a central region of the height dimension.

Figure 7:
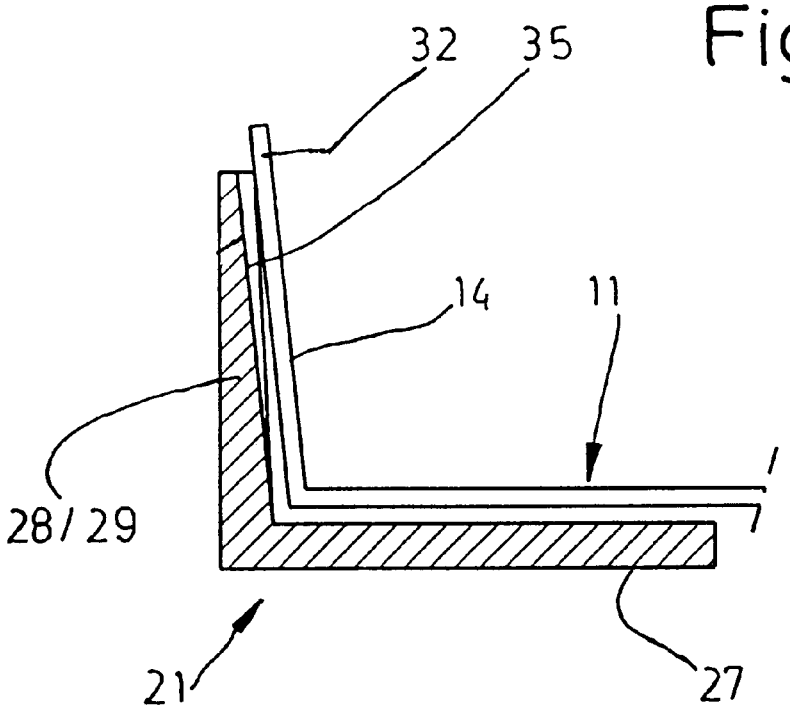
FIG. 7 shows a cross-section of a detail along section plane VII—VII of FIG. 6.
Figure 8:
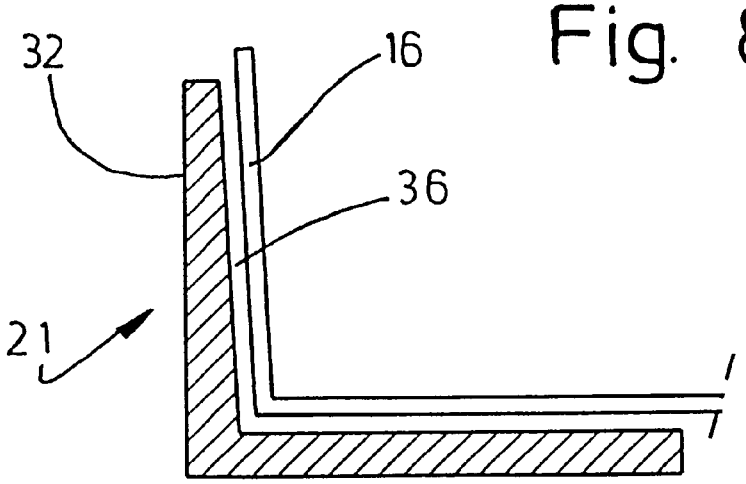
FIG. 8 shows a cross-section which corresponds to FIG. 7 and is taken along an offset section plane VIII—VIII of FIG. 6.

As a result of the mutually offset inner surfaces of the pocket side walls 28, 29, on the one hand, and of the protrusions 32, on the other hand, the inner side tabs 14, on the one hand, and the inner lid side tabs 16, on the other hand, likewise extend in different planes. As can be seen from FIGS. 7 and 8, the aforementioned folding tabs are offset at an acute angle with respect to one another. Inner surfaces 35 of the pocket side walls 28, 29, on the one hand, and inner surfaces 36 of the protrusion 32, on the other hand, are arranged at different angles of inclination with respect to the pocket base 27. In the case of the present exemplary embodiment, the inner surface 35 of the pocket side walls 28, 29 is designed with more pronounced, upwardly diverging inclination than the inner surfaces 36 of the protrusion 32. In the case of the present exemplary embodiment, an inclination of 5.71° with respect to the vertical is provided for the inner surface 35. For the inner surface 36 of the protrusion 32, the angle is 2.86°.

This relative positioning causes the closure edge 18 to butt against the supporting surface 34 when the blank 11 is pushed into the pocket 21. This surface provides positively locking support since both a radially active retaining component and a vertically active retaining component are present.

The configuration of the supporting surface 34 and the arrangement thereof make it possible for the blank 11 or the largely completed hinge-lid box 10 to be discharged radially from the pocket 21, via the filling opening 24, in the region of the discharge station 26 without the fixed protrusion 32 causing any obstruction. Rather, a corresponding discharge force results first of all in the closure edge 18 sliding along the oblique supporting surface 34, and then in the inner side tab 14 sliding along the protrusion 32. Surprisingly, this means that a fixed element ensures, on the one hand, that the blank 11 is sufficiently secured against undesired displacement in the pocket 21 and, on the other hand, that the hinge-lid box 10 is discharged from the pocket 21 without any disruption.

In the case of the present exemplary embodiment, the blank 11 is additionally secured against upward movement in the pocket 21. For this purpose, retaining tongues 37, 38 are provided on the top borders of the pocket side walls 28, 29, said tongues projecting into the pocket 21 by way of a free end and butting in a supporting manner against a free or top edge of the inner side tabs 14. These retaining tongues 37, 38 are arranged in a fixed manner as well. When the blanks 11 are pushed into the pockets 21, the relevant parts of the blank 11 are moved past the retaining tongues 37,38. The procedure is the same during discharge of the hinge-lid boxes 10 from the pockets 21.

In the region of the protrusion 32, a recess 39 is formed in the upper edge region. This recess 39 is delimited by an obliquely directed edge surface 40 which continues into the gap 33. The recess 39 serves to receive an outwardly-shaped part of the blank, namely an outwardly-shaped tip 41 of the (inner) lid side tab 16.

The pocket 21 formed in the manner described herein can also be used in the case of folding turrets which are driven in rotation in a vertical plane, provided that there are pockets which are open in the direction in which centrifugal forces act. Furthermore, it is also possible for the aforementioned idea to be used for fixing other kinds of packs in pockets, provided that supporting edges are available.

What is claimed:

1. A packaging machine for producing packs (10), and having a rotating folding turret (20) on whose circumference there are arranged a plurality of approximately radially directed pockets (21) of U-shaped cross-section which are open on the radially outer side for forming a filling opening (24) for receiving blanks (11) or partially completed packs (10), the U-shaped folded blanks (11) abutting the pocket side walls (28, 29) with pack side tabs (14) and lid side tabs (16), said pack side tabs (14) and said lid side tabs (16) being delimited from one another by obliquely directed pack closure edges (18) and lid closure edges (19), respectively, wherein:

arranged on the pocket side walls (28, 29) in a radially exterior region, adjacent to the filling opening (24), is an inwardly projecting stop or protrusion (32) against which the pack closure edge (18) of each pack side tab (14) butts;

the stop or protrusion (32) on the inside of the pocket side wall (28, 29) has an obliquely directed abutment surface or supporting surface (34) for the pack closure edge (18): and the supporting surface (34) for the pack closure edge (18) is beveled inwardly in the direction of the radially outer, open side of the pocket (21).

2. A packaging machine for producing packs (10), and having a rotating folding turret (20) on whose circumference there are arranged a plurality of approximately radially directed pockets (21) of U-shaped cross-section which are open on the radially outer side for forming a filling opening (24) for receiving blanks (11) or partially completed packs (10), the U-shaped folded blanks (11) abutting the pocket side walls (28, 29) with pack side tabs (14) and lid side tabs (16), said pack side tabs (14) and said lid side tabs (16) being delimited from one another by obliquely directed pack closure edges (18) and lid closure edges (19), respectively, wherein:

arranged on the pocket side walls (28, 29) in a radially exterior region, adjacent to the filling opening (24), is an inwardly projecting stop or protrusion (32) against which the pack closure edge (18) of each pack side tab (14) butts; and the protrusion (32) is part of the pocket side wall (28, 29), and is separated off from the remaining part of the pocket side wall (28, 29) by a gap (33).

3. A packaging machine for producing packs (10), and having a rotating folding turret (20) on whose circumference there are arranged a plurality of approximately radially directed pockets (21) of U-shaped cross-section which are open on the radially outer side for forming a filling opening (24) for receiving blanks (11) or partially completed tacks (10), the U-shaped folded blanks (11) abutting the pocket side walls (28, 29) with pack side tabs (14) and lid side tabs (16), said pack side tabs (14) and said lid side tabs (16) being delimited from one another by obliquely directed pack closure edges (18) and lid closure edges (19), respectively, wherein:

arranged on the pocket side walls (28, 29) in a radially exterior region, adjacent to the filling opening (24), is an inwardly projecting stop or protrusion (32) against which the pack closure edge (18) of each pack side tab (14) butts; and the inner lid side tab (16) of the blank (11) abutting the protrusion (32) is offset inwards at an acute angle with respect to the adjoining inner pack side tab (14).

4. A packaging machine for producing packs (10), and having a rotating folding turret (20) on whose circumference there are arranged a plurality of approximately radially directed pockets (21) of U-shaped cross-section which are open on the radially outer side for forming a filling opening (24) for receiving blanks (11) or partially completed packs (10), the U-shaped folded blanks (11) abutting the pocket side walls (28, 29) with pack side tabs (14) and lid side tabs (16), said pack side tabs (14) and said lid side tabs (16) being delimited from one another by obliquely directed pack closure edges (18) and lid closure edges (19), respectively, wherein:

arranged on the pocket side walls (28, 29) in a radially exterior region, adjacent to the filling opening (24), is an inwardly projecting stop or protrusion (32) against which the pack closure edge (18) of each pack side tab (14) butts;

the pocket side walls (28, 29) are inclined divergently upwards or to the open side, corresponding inner surfaces (35) being formed in the process; and corresponding inner surfaces (36) of the protrusion (32) are inclined to a lesser degree than the inner surfaces (35) of the remaining part of the pocket side walls (28, 29).

5. The packaging machine according to claim 2, characterized in that the stop or protrusion (32) has a recess (39) which is in an upper area removed from the filling opening (24), and which connects to the gap (33).

6. The packaging machine according to claim 1, wherein the protrusion (32) is part of the pocket side wall (28, 29) and is separated off from the remaining part of the pocket side wall (28, 29) by a gap (33).

* * * * *